United States Patent [19]

Kalnin

[11] 4,073,869

[45] Feb. 14, 1978

[54] INTERNAL CHEMICAL MODIFICATION OF CARBON FIBERS TO YIELD A PRODUCT OF REDUCED ELECTRICAL CONDUCTIVITY

[75] Inventor: Ilmar L. Kalnin, Millington, N.J.

[73] Assignee: Celanese Corporation, New York, N.Y.

[21] Appl. No.: 584,098

[22] Filed: June 5, 1975

[51] Int. Cl.[2] ..... D01F 9/12; D06B 19/00; C08K 3/04

[52] U.S. Cl. ..... 423/447.1; 8/115.5; 106/307; 423/447.2; 423/460

[58] Field of Search ..... 423/447, 447.1, 447.2, 423/460; 106/307; 264/29; 8/115.5

[56] References Cited

U.S. PATENT DOCUMENTS

| | | | |
|---|---|---|---|
| 3,746,560 | 7/1973 | Goan et al. | 423/447 X |
| 3,853,610 | 12/1974 | Byrne et al. | 423/447 X |

FOREIGN PATENT DOCUMENTS

| | | | |
|---|---|---|---|
| 1,551,282 | 12/1968 | France | 423/447 |
| 1,238,308 | 7/1971 | United Kingdom | 423/447 |

OTHER PUBLICATIONS

Harris et al., "J. Material Science" (4), 1969, pp. 432–438.

Derwent Japanese, 11.4.68–17.4.68, vol. 7, No. 15, p. 6.

Chemical Abstracts, vol. 64, 1966, 12862(b,c,d).

*Primary Examiner*—Edward J. Meros

[57] ABSTRACT

The internal structure of carbon fibers (as defined) is modified to yield a fibrous product having a bound oxygen content of about 3 to 30 percent by weight which exhibits substantially different bulk properties than that of the starting material. The carbon fiber precursor is contacted with a strong acid medium comprising nitric acid and optionally sulfuric acid and water (as defined) under conditions found capable of producing the desired internal chemical modification. In a preferred embodiment of the process the strong acid medium is formed by a combination (as defined) of fuming nitric acid and fuming sulfuric acid. The fibrous product exhibits, inter alia, reduced electrical and thermal conductivities, and particularly is suited for use as an ablative reinforcing medium.

23 Claims, No Drawings

INTERNAL CHEMICAL MODIFICATION OF CARBON FIBERS TO YIELD A PRODUCT OF REDUCED ELECTRICAL CONDUCTIVITY

BACKGROUND OF THE INVENTION

In the search for high performance materials, considerable interest has been focused upon carbon fibers. Such carbon fibers contain at least 90 percent carbon by weight and commonly are formed by the thermal treatment of a polymeric fibrous precursor. The term "carbon fibers" is used herein in its generic sense and includes graphite fibers as well as amorphous carbon fibers. Graphite fibers are defined herein as fibers which have a predominant X-ray diffraction pattern characteristic of graphite. Amorphous carbon fibers, on the other hand, are defined as fibers which exhibit an essentially amorphous X-ray diffraction pattern. Graphite fibers generally have a higher Young's modulus than do amorphous carbon fibers and in addition are more highly electrically and thermally conductive.

Industrial high performance materials of the future are projected to make substantial utilization of fiber reinforced composites, and carbon fibers theoretically have among the best properties of any fiber for use as high strength reinforcement. Among these desirable properties are corrosion and high temperature resistance, low density, high tensile strength, and high modulus. Graphite is one of the very few known materials which tensile strength increases with temperature. Uses for carbon fiber reinforced composites include aerospace structural components, rocket motor casings, deep-submergence vessels, electrical heaters, hot rolls, bearings, low-shrinkage molds, and ablative materials for heat shields on re-entry vehicles.

In the prior art numerous materials have been proposed for use as possible matrices in which carbon fibers may be incorporated to provide reinforcement and produce a composite article. The matrix material which is selected is commonly a thermosetting resinous material and is commonly selected because of its ability to also withstand highly elevated temperatures. Metallic matrix materials may also be utilized.

Heretofore carbon fibers commonly have been subjected to some form of surface modification treatment in order to enhance their ability to adhere to a matrix material. For instance, various techniques have been proposed in the past for modifying the fiber surface properties of a previously formed carbon fiber in order to make possible improved adhesion when present in a composite article. See, for instance, U.S. Pat. No. 3,476,703 and British Patent No. 1,180,441 to Nicholas J. Wadsworth and William Watt wherein it is taught to heat a carbon fiber normally within the range of 350° C. to 850° C. (e.g. 500° to 600° C.) in an oxidizing atmosphere such as air for an appreciable period of time. Other atmospheres contemplated for use in the process include an oxygen rich atmosphere, pure oxygen, or an atmosphere containing an oxide of nitrogen from which free oxygen becomes available such as nitrous oxide and nitrogen dioxide. Carbon fiber surface modification processes involving treatment in a gaseous atmosphere are disclosed in commonly assigned U.S. Pat. Nos. 3,723,150; 3,723,607; 3,745,104 and 3,754,957. Other carbon fiber surface treatments involving the use of acids are referred to in Belgian Patent No. 708,651, British Patent No. 1,238,308 and U.S. Pat. Nos. 3,597,301, and 3,660,140. Such surface treatments result in an insignificant pick-up of bound oxygen upon the fiber surface, e.g. less than about 0.05 percent by weight, and commonly no substantial reduction in the bulk electrical conductivity of the fibrous material, e.g. less than about a 0.1 percent reduction. These surface treatments have been concerned with achieving an interaction between surface carbon atoms and the reacting medium to form suitable complexes capable of promoting adhesion between the fiber and a resin matrix during composite article formation. The bulk properties such as density, elastic moduli, conductivity, and internal microstructure, are unaffected by such prior art surface treatments.

It is an object of the present invention to provide an improved specifically defined process for the internal chemical modification of a carbonaceous fibrous material.

It is an object of the present invention to provide an improved process for modifying the bulk physical properties of carbon fibers.

It is an object of the present invention to provide an improved process for substantially lowering the electrical conductivity of carbon fibers.

It is an object of the present invention to provide an improved process for substantially lowering the thermal conductivity of a carbonaceous fibrous material.

It is an object of the present invention to provide an improved process for modifying the bulk physical properties of a carbonaceous fibrous material without significant deterioration of other important fiber properties, e.g. tensile strength, strain to failure, and corrosion resistance.

It is an object of the present invention to provide novel carbon fibers exhibiting an electrical conductivity which differs from the ordinary electrical conductivities of about 450 to 1,600 $ohm^{-1}cm^{-1}$ commonly exhibited by carbon fibers at 25° C.

It is an object of the present invention to provide novel carbon fibers containing about 3 to 30 percent bound oxygen by weight, having an average single filament tenacity of at least 200,000 psi, and exhibiting a substantially reduced electrical conductivity, e.g. about 0.1 to 300 $ohm^{-1}cm^{-1}$ measured at 25° C.

It is another object of the present invention to provide chemically modified carbon fibers having a substantially lower elastic modulus, and a substantially higher strain to fracture.

These and other objects, as well as the scope, nature, and utilization of the invention, will be apparent to those skilled in the art from the following detailed description and appended claims.

SUMMARY OF THE INVENTION

It has been found that an improved process for the internal chemical modification of a carbonaceous fibrous material comprising at least 90 percent carbon by weight comprises:

(a) contacting the fibrous material for about 5 to 120 minutes with a strong acid medium comprising nitric acid at a temperature of about 60° to 95° C. wherein the mole ratio of nitric acid to sulfuric acid present in the medium ranges between about 1 to 0 and 1 to 8 and the concentration of water in the acid medium ranges from 0 to 35 mole percent based upon the total mole concentration of the acids and the water, and (b) removing excess acid adhering to the resulting carbonaceous fibrous material to yield a fibrous product containing about 3 to 30 percent bound oxygen by weight which exhibits a substantially reduced electrical conductivity.

The resulting fibrous material is particularly suited for use as a reinforcing material of low thermal conductivity for use in an ablative composite material.

DESCRIPTION OF PREFERRED EMBODIMENTS

The Starting Material

The fibers which are modified in accordance with the present process are carbonaceous and contain at least about 90 percent carbon by weight. Such carbon fibers may exhibit either an amorphous carbon or a predominantly graphitic carbon X-ray diffraction pattern. In a preferred embodiment of the process the carbonaceous fibers which undergo surface treatment contain at least about 95 percent carbon by weight, and at least about 99 percent carbon by weight in a particularly preferred embodiment of the process.

The carbonaceous fibrous materials may be present as a continuous length in a variety of physical configurations provided substantial access to the fiber is possible during the treatment described hereafter. For instance, the carbonaceous fibrous materials may assume the configuration of a continuous length of a multifilament yarn, tape, tow, strand, cable, or similar fibrous assemblage. In a preferred embodiment of the process the carbonaceous fibrous material is one or more continuous multifilament yarn or tow. Alternatively, the carbonaceous fibrous material may be provided as a fiber assemblage such as a woven or knitted fabric.

When the carbonaceous fibrous material which is treated in the present process is a yarn it optionally may be provided with a twist which tends to improve the handling characteristics. For instance, a twist of about 0.1 to 5 tpi, and preferably about 0.3 to 1.0 tpi, may be imparted to a multifilament yarn. Also, a false twist may be used instead of or in addition to a real twist. Alternatively, one may select continuous bundles of fibrous material which possess essentially no twist.

The carbonaceous fibers which serve as the starting material in the present process may be formed in accordance with a variety of techniques as will be apparent to those skilled in the art. For instance, organic polymeric fibrous materials which are capable of undergoing thermal stabilization may be initially stabilized by treatment in an appropriate atmosphere at a moderate temperature (e.g. 200° to 400° C.), and subsequently heated to an inert atmosphere at a more highly elevated temperature, e.g. 900° to 1000° C., or more, until a carbonaceous fibrous material is formed. If the thermally stabilized material is heated to a maximum temperature of 2,000° to 3,100° C. (preferably 2,400° C. to 3,100° C.) in an inert atmosphere, substantial amounts of graphitic carbon are commonly detected in the resulting carbon fiber, otherwise the carbon fiber will commonly exhibit an essentially amorphous X-ray diffraction pattern.

The exact temperature and atmosphere utilized during the initial stabilization of an organic polymeric fibrous material commonly vary with the composition of the precursor as will be apparent to those skilled in the art. During the carbonization reaction elements present in the fibrous material other than carbon (e.g. oxygen and hydrogen) are substantially expelled. Suitable organic polymeric fibrous materials from which the fibrous material capable of undergoing carbonization may be derived include an acrylic polymer, a cellulosic polymer, a polyamide, a polybenzimidazole, polyvinyl alcohol, pitch, etc. As discussed hereafter acrylic polymeric materials are particularly suited for use as precursors in the formation of carbonaceous fibrous materials. Illustrative examples of suitable cellulosic materials include the natural and regenerated forms of cellulose, e.g. rayon. Illustrative examples of suitable polyamide materials include the aromatic polyamides, such as nylon 6T, which is formed by the condensation of hexamethylenediamine and terephthalic acid. An illustrative example of a suitable polybenzimidazole is poly-2,2′-m-phenylene-5,5′-bibenzimidazole.

A fibrous acrylic polymeric material prior to stabilization may be formed primarily of recurring acrylonitrile units. For instance, the acrylic polymer should contain not less than about 85 mole percent of recurring acrylonitrile units with not more than about 15 mole percent of a monovinyl compound which is copolymerizable with acrylonitrile such as styrene, methyl acrylate, methyl methacrylate, vinyl acetate, vinly chloride, vinylidene chloride, vinyl pyridine, and the like, or a plurality of such monovinyl compounds.

Representative thermal stabilization processes for an acrylic fibrous material are disclosed in commonly assigned U.S. Pat. Nos. 3,539,295; 3,592,595; 3,632,092; 3,650,668; 3,656,882; 3,656,883; 3,708,326; 3,820,951; 3,826,611; and 3,850,876. The thermally stablized acrylic fibrous material commonly contains up to about 65 percent carbon by weight, contains a bound oxygen content of at least about 7 percent by weight as determined by the Unterzaucher or other suitable analysis, retains its original fibrous configuration essentially intact, and is non-burning when subjected to an ordinary match flame. Thermal stabilization reactions involving treatment in a sulfur dioxide atmosphere may be utilized.

In preferred techniques for forming the carbon fiber starting material for use in the present process a stabilized acrylic fibrous material is carbonized and graphitized while passing through a temperature gradient present in a heating zone in accordance with the procedures described in commonly assigned U.S. Ser. Nos. 244,990, filed May 8, 1972, (now U.S. Pat. No. 3,900,556), and 354,469, filed Apr. 25, 1973 (now U.S. Pat. No. 3,954,950), and U.S. Pat. No. 3,775,520.

In accordance with a preferred carbonization and graphitization technique a continous length of stabilized acrylic fibrous material which is non-burning when subjected to an ordinary match flame and derived from an acrylic fibrous material selected from the group consisting of an acrylonitrile homopolymer and acrylonitrile copolymers which contain at least about 85 percent of acrylonitrile units and up to about 15 mole percent of one or more monovinyl units copolymerized therewith is converted to a graphitic fibrous material while preserving the original fibrous configuration essentially intact while passing through a carbonization/graphitization heating zone containing an inert gaseous atmosphere and a temperature gradient in which the fibrous material is raised within a period of about 20 to about 300 seconds from about 800° C. to a temperature of about 1,600° C. to form a continuous length of carbonized fibrous material, and in which the carbonized fibrous material is subsequently raised from about 1,600° C. to a maximum temperature of at least about 2,400° C. within a period of about 3 to 300 seconds where it is maintained for about 10 seconds to about 200 seconds to form a continuous length of graphitic fibrous material.

The equipment utilized to produce the heating zone used to produce the carbonaceous starting material may be varied as will be apparent to those skilled in the art. It is essential that the apparatus selected be capable of producing the required temperature while excluding the presence of an oxidizing atmosphere.

In a preferred technique the continuous length of fibrous material undergoing carbonization is heated by use of an induction furnace. In such a procedure the fibrous material may be passed in the direction of its length through a hollow graphite tube or other susceptor which is situated within the windings of an induction coil. By varying the length of the graphite tube, the length of the induction coil and the rate at which the fibrous material is passed through the graphite tube, many apparatus arrangements capable of producing carbonization or carbonization and graphitization may be selected. For large scale production it is of course preferred that relatively long tubes or susceptors be used so that the fibrous material may be passed through the same at a more rapid rate while being carbonized or carbonized and graphitized. The temperature gradient of a given apparatus may be determined by conventional optical pyrometer measurements as will be apparent to those skilled in the art. The fibrous material because of its small mass and relatively large surface area instantaneously assumes essentially the same temperature as that of the zone through which it is continuously passed. Alternatively, the carbonization and graphitization zones may be isolated.

THE INTERNAL CHEMICAL MODIFICATION

The internal chemical modification of the carbonaceous fibrous material is carried out by contact with a strong acid medium comprising nitric acid as described. The acid medium utilized in the present process tends to be stronger than those acid media heretofore proposed for the surface treatment of carbon fibers and produces different results. More specifically, the bulk physical properties inherently exhibited by the carbon fibers are altered when the defined process conditions are followed with no substantial change in important fiber properties such as tenacity, corrosion resistance, etc. The term "bulk" physical properties as used herein indicates a magnitude in three dimensions. Bulk properties can be differentiated from surface physical properties which can be viewed as having a magnitude in only two dimensions.

The strong acid medium comprising nitric acid possesses a mole ratio of nitric acid to sulfuric acid between about 1 to 0 and 1 to 8 and a free water concentration from 0 to 35 mole percent based upon the total mole concentration of the nitric and sulfuric acids and water. In a preferred embodiment of the process the strong acid medium is a mixture of nitric acid and sulfuric acid wherein the mole ratio of nitric acid to sulfuric acid within the mixture ranges between about 8 to 1 and 1 to 8 and the concentration of water in admixture with the acids ranges from 0 to 30 mole percent based upon the total mole concentration of the nitric and sulfuric acids and water. The mixture of nitric acid and sulfuric acid advantageously may be formed by the admixture of commercially available fuming nitric and fuming sulfuric acids. As generally defined by chemical manufacturers when identifying a fuming nitric acid, the nitric acid component is present in a mole concentration of greater than 86 percent by weight, with the remainder being mainly water and dissolved oxides of nitrogen. For instance, commercially available fuming nitric acid may be selected which comprises 90 percent by weight nitric acid, up to approximately 0.1 percent by weight oxides of nitrogen (as nitrogen dioxide), and about 9 to 10 percent by weight water.

Commercially available fuming sulfuric acid may be selected which contains about 5 to 40 percent by weight free sulfur trioxide. The sulfur trioxide upon contact with water present in the strong acid medium combines with the water and eventually forms additional sulfuric acid. A particularly preferred commercially available fuming sulfuric acid for use in the process contains about 20 percent by weight sulfur trioxide.

The relative proportions of nitric acid, sulfuric acid, and water may be varied so long as the strong acid medium falls within the above defined parameters. In the absence of the nitric acid component the sulfuric acid component has been found to be ineffective in the production of the desired results with respect to internal chemical modification. More specifically, it is noted that in the absence of nitric acid, a treatment with the fuming sulfuric acid leaves the bulk properties of the carbon fibers substantially unchanged. When more than 35 mole percent free water is present in the acid medium, it has been found that the desired internal chemical modification is not achieved. More specifically, it has been noted that when more than 35 mole percent free water is present in the acid medium, the medium produces relatively small changes in the carbon fiber bulk properties at treatment times which are too long to be practical.

Since fuming nitric acid and fuming sulfuric acid react exothermically with free water, the acid mixtures are prepared so as to avoid excessive heat-up and violent evaporation of the water and splattering of the acid. During mixing the vessel containing the mixture may be cooled while incremental additions are made to the stirred vessel. Since the fuming acid mixture absorbs atmospheric moisture, the container should be kept tightly covered when not in use.

The strong acid medium heretofore described is provided at a temperature of about 60° to 95° C., and preferably at a temperature of 70° to 85° C. when contacted with the carbonaceous fibrous material to accomplish the internal chemical modification. Contact times commonly range from about 5 to 120 minutes, with the shorter contact times generally corresponding to the higher temperatures for the strong acid medium. When the strong acid medium is provided at a temperature of about 70° to 85° C. contact times of 10 to 30 minutes generally are adequate. Also, the contact time tends to directly relate to the quantity of free water in the strong acid medium.

The activity of the strong acid medium is influenced more by its temperature than residence time. For instance, an internal chemical modification which may require 120 minutes at 75° C., may be produced within 30 minutes at 82° C. Therefore, precise temperature regulation (e.g. ±0.5° C.) is recommended when highly reproducable property changes are desired.

As previously indicated, the physical configuration of the carbonaceous fibrous material may be varied at the time of the contact with the strong acid medium. The fibrous material may be statically immersed in the acid medium during the contact period, or a continuous length of the same may be continuously passed in the direction of its length through a vessel containing the strong acid medium.

Excess acid adhering to the resulting carbonaceous fibrous material is next removed by any convenient technique. For instance, the removal of adhering acid may be accomplished by evaporation at an elevated temperature, e.g. by heating in a vented oven at 200° C. for 15 minutes, or less at higher temperatures. Alternatively, adhering acid may be removed by washing, followed by drying in a circulating hot air oven. The fibrous material may be contacted with the wash medium until no acidity is detected. A water wash medium conveniently may be selected. Alternatively, the fibrous material may be washed in relatively inert oxygen-free solvents, such as carbon disulfide, carbontetrachloride, dichloromethane, etc.

The internal chemical modification process of the present invention results in the introduction of about 3 to 30 percent bound oxygen by weight into the carbonaceous fibrous material as determined by the Unterzaucher, or other suitable analysis. Commonly the bound oxygen is introduced in a concentration of about 4 to 20 percent by weight. The fact that bound oxygen is present within the fibrous material rather than exclusively upon the fiber surface is evidenced by an examination of the fiber surfaces at high magnification (e.g. 10,000×) by scanning electron microscopy which reveals that the surface morphological features (e.g. smoothness, fibrillarity, defect concentration, etc.) are not changed as a result of the treatment, whereas it is known to those skilled in the art that extensive reaction of the fiber surface carbon with oxygen forms surface complexes which result in changes of the fiber surface morphology (e.g. formation of etch pits, surface roughness, etc.). In addition the carbon fiber surfaces can accept no more than a few monolayers (e.g. less than 0.05 percent) of oxygen; however usually the amount is lower. For instance, refined microanalytical methods, such as neutron activation analysis, indicate that the maximum amount of surface oxygen for a highly surface treated carbon fiber is about 0.03 percent, e.g. about 300 parts per million.

It surprisingly has been found that the process of the present invention is capable of substantially changing the bulk physical properties of the carbonaceous fibrous material with no substantial alteration of important fiber properties such as tensile strength. More specifically, the electrical conductivity of the fibrous material is substantially reduced, e.g. by a least 40 percent (preferably at least 50 percent), and the tensile strength of the fibrous material is substantially retained, e.g. remains within ±20 percent of its original value. Carbon fibers having an electrical conductivity of only about 0.1 to 300 $ohm^{-1}cm^{-1}$ may be formed. Other bulk properties such as thermal conductivity are substantially reduced by the present process, e.g. the thermal conductivity commonly is reduced to about 25 to 75 percent of its original value. Carbon fibers having a room temperature thermal conductivity of only about 0.03 to 0.07 watts/cm. ° C. may be formed. The carbon fibers commonly retain a tenacity of at least 200,000 psi, e.g. a tenacity of about 250,000 to 400,000 psi. Other bulk properties which are modified in the course of the present process are the elastic (Young's) modulus which may decrease up to about 50 percent, and the fiber density which generally increases up to about 10 percent.

The resulting fibrous product commonly has a bound oxygen content of about 3 to 30 percent by weight (e.g., about 4 to 20 percent by weight) in combination with an average single filament tenacity of at least 200,000 psi. The bound oxygen content may be determined by the Unterzaucher or other suitable analysis. The bound oxygen is present within the fibrous product and tends to be present at the intercrystalline boundries of a graphitic carbonaceous fibrous material. As indicated, the density of the product tends to be greater than that of the starting material. The Young's modulus of the product tends to be lower than that of the starting material. An average single filament Young's modulus of about 26 to 30 million psi commonly is exhibited by the product when the precursor filaments exhibit a single filament value of about 35 million psi.

The product of the present invention particularly is suited for use in those end use applications where low electrical conductivity and low thermal conductivity are of importance. For instance, the product may be used as the element in a resistance heater, or used as a reinforcing medium in a composite article which serves as an ablative heat shield. Other end use applications where such properties are particularly advantageous include self-heated catalyst supports, electrical heated rollers having diminished heat losses, catalysts for the oxidation of hydrocarbons, etc.

The following examples are given as specific illustrations of the invention. It should be understood, however, that the invention is not limited to the specific details set forth in the examples.

A high strength-intermediate modulus graphitic carbonaceous fibrous material was selected as the starting material. The starting material was commercially available from the Union Carbide Corporation under the designation Thormel 300 carbon fiber and was provided as a continuous multifilament yarn. The yarn consisted of 3,000 filaments and had a total denier of about 1,800. The starting material was derived from an acrylic copolymer, contained in excess of 90 percent carbon by weight, and contained no detectable bound oxygen.

The conditions utilized are summarized in the following Table. In each instance a like sample of the carbon fiber yarn was wound upon a bobbin which was coated with a tetrafluoroethylene fluorocarbon polymer, and immersed in an acid medium having the composition indicated in the Table. In each instance excess acid adhering to the yarn following the treatment in the strong acid medium was removed by rinsing in cold (5° to 15° C.) flowing water until the pH value of the water before and after the rinse remained unchanged. Adequate washing was usually accomplished within about 15 to 20 minutes.

A significant internal chemical modification is accomplished when following the conditions of the present process as detected by an analysis for bound oxygen content. Also the electrical conductivity of the product is substantially reduced. It will be noted in Comparative Example A that the desired results are not achieved when 70 percent by weight aqueous concentrated nitric acid (i.e. 40 mole percent nitric acid and 60 mole percent water) serves as the acid medium. Comparative Example B indicates that the desired results are not achieved when the acid medium is a common commercially available concentrated sulfuric acid. Comparative Example C indicates that the desired results are not achieved when the acid medium is a commercially available fuming sulfuric acid.

The thermal conductivity of fibers treated in accordance with the present process additionally was found to decrease when tested by use of a commercially available Colora Thermoconductometer apparatus. For instance, the control had a room temperature thermal conductivity of about 0.09 watts/cm. ° C. A fiber sample treated in accordance with Example No. 11 (described in Table) exhibited a room temperature thermal conductivity of about 0.07 watts/cm. ° C., and a fiber sample treated in accordance with Example No. 13 (described in Table) exhibited a room temperature electrical conductivity of about 0.055 watts/cm. ° C.

TABLE

| Example No. | Strong Acid Medium $HNO_3$ (mole %) | $H_2SO_4$ (mole %) | $H_2O$ (mole %) | Contact Temp. (° C.) | Time (min.) | Single Filament Tensile Strength ($10^3$psi) | Single Filament Young's Modulus ($10^6$psi) | Bulk Density (g./c.c.) | Electrical Conductivity ($ohm^{-1}cm.^{-1}$) | Fiber Bound Oxygen (wt. %) |
|---|---|---|---|---|---|---|---|---|---|---|
| Control | — | — | — | — | — | 360 | 35.3 | 1.74 | 510 | 0 |
| 1 | 72 | 0 | 28 | 75 | 30 | 315 | 26.0 | 1.80 | na | na |
| 2 | 72 | 0 | 28 | 80 | 120 | 170 | 12.2 | 1.84 | 30 | 8.6 |
| 3 | 67 | 9 | 24 | 75 | 30 | 225 | 21.3 | 1.87 | na | na |
| 4 | 64 | 16 | 20 | 75 | 30 | 185 | 14.0 | 1.84 | 0.9 | na |
| 5 | 64 | 16 | 20 | 80 | 120 | 21 | 2.7 | 1.80 | na | na |
| 6 | 51 | 39 | 10 | 75 | 30 | 180 | 15.1 | 1 85 | 67 | 27.4 |
| 7 | 51 | 39 | 10 | 80 | 120 | 15 | 0.9 | 1.39 | 0.3 | na |
| 8 | 33 | 67 | 0 | 60 | 120 | 360 | 31.5 | 1.77 | 300 | 2.6 |
| 9 | 33 | 67 | 0 | 75 | 30 | 430 | 34.6 | 1.76 | na | na |
| 10 | 33 | 67 | 0 | 75 | 30 | 440 | 32.3 | 1.79 | na | na |
| 11 | 33 | 67 | 0 | 80 | 30 | 425 | 30.4 | 1.80 | na | na |
| 12 | 33 | 67 | 0 | 80 | 120 | 350 | 26.0 | 1.83 | 4 | 12.8 |
| 13 | 33 | 67 | 0 | 85 | 30 | 425 | 30.4 | 1.80 | na | na |
| 14 | 33 | 67 | 0 | 85 | 120 | 405 | 23.8 | 1.83 | na | na |
| 15 | 15 | 61 | 24 | 75 | 30 | 365 | 35.2 | 1.74 | na | na |
| 16 | 18 | 82 | 0 | 75 | 30 | 405 | 35.5 | 1.74 | na | na |
| Comparative A | 40 | 0 | 60 | 80 | 120 | 365 | 34.5 | 1.75 | 420 | <0.1 |
| Comparative B | 0 | 78 | 22 | 80 | 120 | 340 | 34.3 | 1.74 | 450 | 0 |
| Comparative C | 0 | 100 | 0 | 80 | 120 | 380 | 35.5 | 1.75 | 500 | 0 |

na = not available

Although the invention has been described with preferred embodiments, it is to be understood that variations and modifications may be resorted to as will be apparent to those skilled in the art. Such variations and modifications are to be considered within the purview and the scope of the claims appended hereto.

I claim:

1. An improved process for the internal chemical modification of a carbonaceous fibrous material comprising at least 90 percent carbon by weight comprising:

(a) contacting said fibrous material for about 5 to 120 minutes with a strong acid medium consisting essentially of nitric acid at a temperature of about 60° to 95° C. wherein the mole ratio of nitric acid to sulfuric acid present in said medium ranges between about 1 to 0 and 1 to 8 and the concentration of water in said acid medium ranges from 0 to 35 mole percent based upon the total mole concentration of said acids and said water, and (b) removing excess acid adhering to the resulting carbonaceous fibrous material to yield a fibrous product containing about 3 to 30 percent bound oxygen by weight which exhibits a substantially reduced electrical conductivity by at least 40 percent when compared to that of the carbonaceous fibrous material prior to said contact and a single filament tenacity of at least 200,000 psi.

2. An improved process for the chemical modification of a carbonaceous fibrous material in accordance with claim 1 wherein said carbonaceous fibrous material which serves as the starting material is derived from an acrylic fibrous material.

3. An improved process for the chemical modification of a carbonaceous fibrous material in accordance with claim 1 wherein said carbonaceous fibrous material is a continuous length of a multifilament yarn.

4. An improved process for the chemical modification of a carbonaceous fibrous material in accordance with claim 1 wherein said carbonaceous fibrous material is a continuous length of a multifilament tow.

5. An improved process for the chemical modification of a carbonaceous fibrous material in accordance with claim 1 wherein said strong acid medium is at a temperature of about 70° to 85° C. when contacted with said fibrous material.

6. An improved process for the chemical modification of a carbonaceous fibrous material in accordance with claim 1 wherein said strong acid medium is a mixture of nitric acid and sulfuric acid and said mixture is formed upon the admixture of fuming nitric acid and fuming sulfuric acid.

7. An improved process for the chemical modification of a carbonaceous fibrous material in accordance with claim 1 wherein said removal of excess acid adhering to the resulting carbonaceous fibrous material is accomplished by evaporation at an elevated temperature.

8. An improved process for the chemical modification of a carbonaceous fibrous material in accordance with claim 1 wherein said removal of excess acid adhering to the resulting carbonaceous fibrous material is accomplished by washing.

9. An improved process for the internal chemical modification of a carbonaceous fibrous material containing at least 90 percent carbon by weight comprising:

(a) contacting said fibrous material for about 5 to 120 minutes with a mixture consisting essentially of nitric acid and sulfuric acid at a temperature of about 60° to 95° C. wherein the mole ratio of nitric acid to sulfuric acid within said mixture ranges between about 8 to 1 and 1 to 8 and the concentration of water in admixture with said acids ranges from 0 to 30 mole percent based upon the total mole concentration of said acids and said water, and (b) removing excess acids adhering to the resulting carbonaceous fibrous material to yield a fibrous product containing about 3 to 30 percent bound oxygen by weight which exhibits a substantially reduced electrical conductivity by at least 40 percent when compared to that of the carbonaceous fibrous material prior to said contact and a single filament tenacity of at least 200,000 psi.

10. An improved process for the chemical modification of a carbonaceous fibrous material in accordance with claim 9 wherein said carbonaceous fibrous material which serves as the starting material is derived from an acrylic fibrous material.

11. An improved process for the chemical modification of a carbonaceous fibrous material in accordance with claim 10 wherein said carbonaceous fibrous material is a continuous length of a multifilament yarn.

12. An improved process for the chemical modification of a carbonaceous fibrous material in accordance with claim 10 wherein said carbonaceous fibrous material is a continuous length of a multifilament tow.

13. An improved process for the chemical modification of a carbonaceous fibrous material in accordance with claim 10 wherein said mixture of acids is at a temperature of about 70° to 85° C. when contacted with said fibrous material.

14. An improved process for the chemical modification of a carbonaceous fibrous material in accordance with claim 10 wherein said mixture of nitric acid and sulfuric acid is formed upon the admixture of fuming nitric acid and fuming sulfuric acid.

15. An improved process for the chemical modification of a carbonaceous fibrous material in accordance with claim 10 wherein said removal of excess acids adhering to the resulting carbonaceous fibrous material is accomplished by evaporation at an elevated temperature.

16. An improved process for the chemical modification of a carbonaceous fibrous material in accordance with claim 10 wherein said removal of excess acids adhering to the resulting carbonaceous fibrous material is accomplished by washing.

17. An improved process for the internal chemical modification of a carbonaceous fibrous material containing at least 90 percent carbon by weight which is derived from an acrylic fibrous material comprising:

(a) contacting said fibrous material for about 10 to 30 minutes with a mixture consisting essentially of nitric acid and sulfuric acid at a temperature of about 70° to 85° C. wherein the mole ratio of nitric acid to sulfuric acid within the admixture ranges between about 8 to 1 and 1 to 8 and the concentration of water in admixture with said acids ranges from 0 to 30 mole percent based upon the total mole concentration of said acids and said water, and (b) removing excess acids adhering to the resulting carbonaceous fibrous material to yield a fibrous product containing about 3 to 30 percent bound oxygen by weight which exhibits a substantially reduced electrical conductivity by at least 40 percent when compared to that of the carbonaceous fibrous material prior to said contact and a single filament tenacity of at least 200,000 psi.

18. An improved process for the chemical modification of a carbonaceous fibrous material in accordance with claim 17 wherein said carbonaceous fibrous material which serves as the starting material is derived from an acrylic fibrous material.

19. An improved process for the chemical modification of a carbonaceous fibrous material in accordance with claim 17 wherein said carbonaceous fibrous material is a continuous length of a multifilament yarn.

20. An improved process for the chemical modification of a carbonaceous fibrous material in accordance with claim 17 wherein said carbonaceous fibrous material is a continous length of a multifilament tow.

21. An improved process for the chemical modification of a carbonaceous fibrous material in accordance with claim 17 wherein said mixture of nitric acid and sulfuric acid is formed upon the admixture of fuming nitric acid and fuming sulfuric acid.

22. An improved process for the chemical modification of a carbonaceous fibrous material in accordance with claim 17 wherein said removal of excess acids adhering to the resulting carbonaceous fibrous material is accomplished by evaporation at an elevated temperature.

23. An improved process for the chemical modification of a carbonaceous fibrous material in accordance with claim 17 wherein said removal of excess acids adhering to the resulting carbonaceous fibrous material is accomplished by washing.

* * * * *